United States Patent [19]

Higuchi et al.

[11] Patent Number: 4,739,127

[45] Date of Patent: Apr. 19, 1988

[54] SNAP SWITCH

[75] Inventors: Mitsutoshi Higuchi; Shinichi Hikita; Minoru Nishio; Shigeo Nakamura, all of Aichi, Japan

[73] Assignee: Kabushiki Kaisha Tokai Rika Denki Seisakusho, Niwa, Japan

[21] Appl. No.: 12,296

[22] Filed: Feb. 9, 1987

[30] Foreign Application Priority Data

Feb. 14, 1986 [JP] Japan ..... 61-18767[U]

[51] Int. Cl.[4] ..... H01H 1/18; H01H 21/40

[52] U.S. Cl. ..... 200/5 R; 200/6 B; 200/67 D; 200/159 B; 200/241; 200/242; 200/339

[58] Field of Search ..... 200/5 A, 6 R, 6 B, 6 BA, 200/6 BB, 6 C, 11 EA, 11 G, 11 J, 11 K, 61.54, 61.55, 61.56, 68.1, 68.2, 68.3, 239, 241, 242, 339, 67 D, 67 DA

[56] References Cited

U.S. PATENT DOCUMENTS

| | | | |
|---|---|---|---|
| 3,255,319 | 6/1966 | Paine | 200/11 EA |
| 3,294,932 | 12/1966 | Barlow | 200/242 |
| 3,879,592 | 4/1975 | Comerford et al. | 200/241 X |
| 3,912,895 | 10/1975 | Plana | 200/241 X |
| 4,436,970 | 3/1984 | Swisher | 200/61.56 |
| 4,438,304 | 3/1984 | Kennedy | 200/5 A X |
| 4,490,591 | 12/1984 | Page | 200/241 X |
| 4,539,444 | 9/1985 | Senoh | 200/242 X |

*Primary Examiner*—J. R. Scott

*Attorney, Agent, or Firm*—Finnegan, Henderson, Farabow, Garrett & Dunner

[57] ABSTRACT

A snap switch with a self-cleaning function having a switch body with a fixed contact and a movable contact for performing make-break operations. A knob, mounted on the switch body, operates a contact operation member causing the movable contact to abut the fixed contact when the knob is rotated by a predetermined rotational angle and further causing the movable contact to slide on the fixed contact when the knob is further rotated.

6 Claims, 3 Drawing Sheets

SNAP SWITCH

BACKGROUND OF THE INVENTION

1. Field Of The Invention

The present invention generally relates to snap switches, and particularly relates to a snap switch having a self-cleaning function.

2. Description Of The Prior Art

A snap switch is known in which a knob is swingably provided on a switch body provided with a fixed contact and a pair of movable contacts, and in which the movable contacts are alternately caused to come into contact with the fixed contact.

In such a snap switch as described above, the movable contact moved by a knob so that the movable contact contacts a perpendicularly disposed fixed contact. A faulty contact will result if dust or the like adheres to the contact surface between the movable and fixed contacts, or if carbide is generated by an arc in a contact switching operation.

SUMMARY OF THE INVENTION

An object of the present invention is to eliminate the foregoing disadvantage in the prior art.

Another object of the present invention is a snap switch in which during a contact switching operation, contacts are caused to come into contact with each other while removing dust, oxides, or the like, to ensure that it is always possible to maintain a good contact condition.

In order to attain the above objects, the snap switch according to the present invention comprises a switch body provided with a fixed contact and a movable contact for performing make-break operations therebetween, a knob swingably mounted on the switch body, a contact operation member operable by the knob to cause the movable contact to abut the fixed contact when the knob is rotated by a predetermined rotational angle, and to further cause the movable contact to slide on the fixed contact when the knob is further rotated.

The movable and fixed contacts may be provided in a first and second set with first and second contact operation members so that when the knob is rotated in a first direction, the first contact operation member causes the movable contact in the first set to come into contact with the fixed contact in the first set and then causes the same movable contact to slide on the same fixed contact under the condition that the former is kept in contact with the latter. When the knob is rotated in a second direction, the second contact operation member causes the movable contact in the second set to come into contact with the fixed contact in the second set and then causes the same movable contact to slide on the same fixed contact under the condition that the former is kept in contact with the latter.

The manner by which the above objects and other objects, features, and advantages of the present invention are attained will be fully apparent from the following detailed description taken in conjunction with the accompanying drawings.

BRIEF DESCRIPTION OF THE DRAWINGS

FIG. 3(*b*) is an enlarged cross-sectional view showing the movable contact portion of the snap switch of FIG. 1;

FIG. 4(*b*) is a diagram for explaining the operation of the snap switch of FIG. 4(*a*);

DETAILED DESCRIPTION OF THE PREFERRED EMBODIMENTS

Referring to the accompanying drawings, embodiments of the snap switch according to the present invention will now be described.

Figure 1:
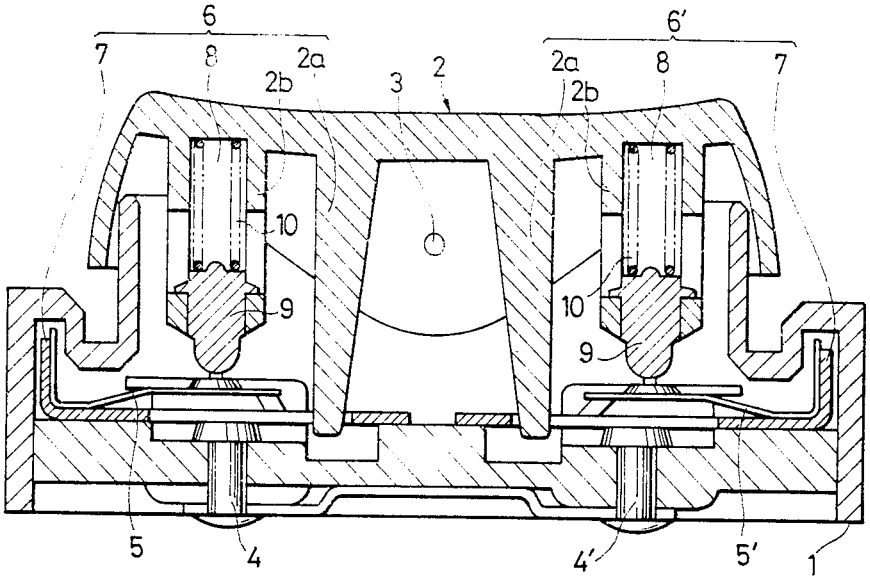
FIG. 1 is a cross-sectional view showing a first embodiment of the snap switch according to the present invention.

FIG. 1 shows a first embodiment of the snap switch according to the present invention. In FIG. 1, a switch body 1 is provided with a knob 2, fixed contacts 4 and 4', movable contacts 5 and 5', and contact operation members 6 and 6'. The knob 2 is swingably mounted on the switch body 1 through a pin 3. The fixed contacts 4 and 4' are disposed in the vicinity of the longitudinally opposite ends of a bottom surface of the switch body 1. The movable contacts 5 and 5' are disposed opposite the fixed contacts 4 and 4', respectively, with a predetermined gap therebetween.

Figure 3A:
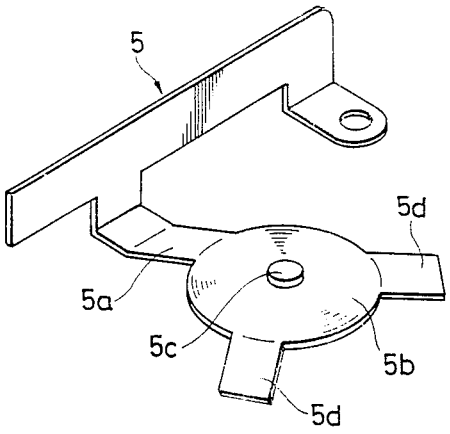
FIG. 3(*a*) is an enlarged perspective view showing the movable contact portion of the snap switch of FIG. 1.
Figure 3B:
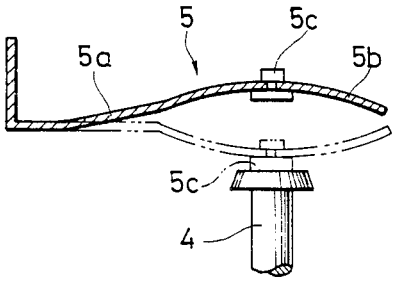

As shown in FIG. 3(*a*), the movable contact 5 is constituted by an arm portion 5*a* of an elastic material having a free end portion shaped into a dome-like portion 5*b*, a contact piece 5*c* fixed at the center of the dome-like portion 5*b* for performing the make-break operation with the corresponding fixed contact 4, and legs 5*d* formed integrally with the dome-like portion 5*b* at its circumference so as to abut on the circumference of a through hole 7*a* of a holder 7 which will be described later. As shown in FIG. 3(*b*), the dome-like portion 5*b* is arranged so that it is reversed (shown by a two-dot chain line in the drawing) when a predetermined urging force acts on the contact piece 5*c* and it returns to its original state when the urging force is removed.

Alternatively, the movable contact 5 may be arranged such that, for example, the free end of the arm portion 5*a* of the movable contact 5 is formed into a flat portion and the contact piece 5*c* is fixed to the flat portion.

Each of the contact operation members 6 and 6' is constituted by the holder 7 movably provided on the switch body 1 for holding the corresponding movable contact 5, a pushing member 8 for urging the contact piece 5*c* as the knob 2 is rotated, and lever 2*a* formed integrally with the knob 2 and engaged with the through hole 7*a* of the holder 7 for actuating the holder 7 in response to the rotation of the knob 2.

The pushing member 8 is constituted by a pushing piece 9 movably provided in a cylindrical portion 2*b* formed integrally with the knob 2, and a spring 10 for urging the pushing piece 9 toward the outside of the cylindrical portion 2b, so that the contact piece 5c is urged by the pushing piece 9 as the knob 2 is rotated to reverse the dome-like portion 5b.

Figure 2:
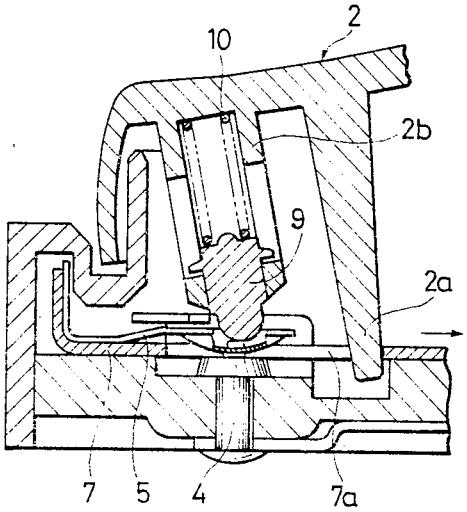
FIG. 2 is a diagram for explaining the operation of the snap switch of FIG. 1.

In the first embodiment of the present invention, when one end portion of the knob 2 is pushed to rotate the knob 2, the pushing portion 9 comes into contact with the contact piece 5c due to the rotation of the knob 2. Then, the pushing portion 9 is urged against the contact piece 5c to thereby reverse the dome-like portion 5b so that the contact piece 5c is caused to come into contact with the fixed contact 4. Next, when the pushing portion 9 is further urged against the contact piece 5c, the contact piece 5c is urged against the fixed contact 4 (at this time, the pushing portion 9 slightly retreats in the cylindrical portion 2b against the spring force of the spring 10), while the lever 2a pushes against the side of the through hole 7a of the holder 7 to thereby cause the holder 7 to move in the direction of the arrow of FIG. 2. As a result, the contact piece 5c slides on the fixed contact 4 under the condition that the former is being urged against the latter.

Therefore, even if dust, a carbide, or the like, adheres to the respective contact surfaces of the fixed contact 4 and the contact piece 5c, the dust or the like will be scraped off before the fixed contact 4 and the contact piece 5c come into contact with each other so that a good contact condition can be obtained therebetween.

Figure 4A:
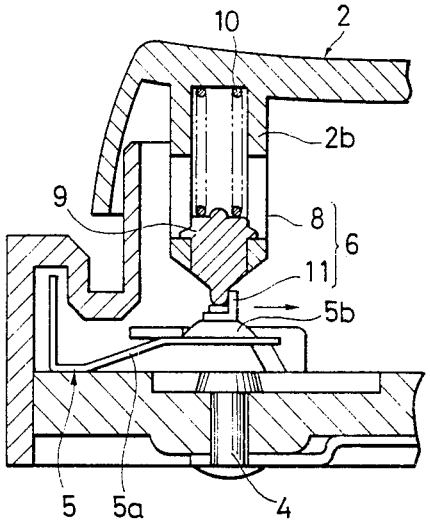
FIG. 4(*a*) is a partial cross-sectional view showing a second embodiment of the snap switch according to the present invention.
Figure 4B:
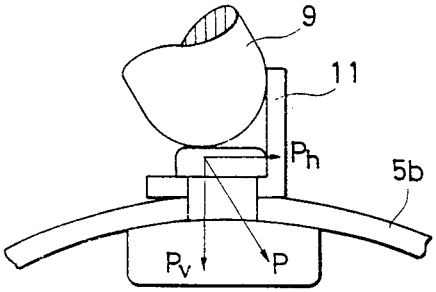

FIGS. 4(*a*) and 4(*b*) show a second embodiment of the snap switch according to the present invention. This embodiment is different from the first embodiment in arrangement of the contact operation member 6. That is, the contact piece 5c is provided with a reception portion 11 that is L-shaped in cross section so that the pushing portion 9 engages the reception portion 11. When the knob 2 is rotated, the dome-like portion 5b is reversed by a vertical component $P_v$ of the urging force P of the pushing portion 9 acting on the reception portion 11 to cause the contact piece 5c to come into contact with the fixed contact 4. When the knob 2 is further rotated, a horizontal component $P_h$ of the urging force P of the pushing portion 9 acting on the reception portion 11 is increased so that the movable contact 5 is caused to move in the direction of the arrow shown in FIG. 4(*a*) by the horizontal component $P_h$. That is, the contact piece 5c is caused to slide on the fixed contact 4.

In this second embodiment, the contact piece 5c is caused to come into contact with, and to slide on, the fixed contact 4 by the vertical and horizontal components, respectively, of the urging force P of the pushing portion 9 acting on the reception portion 11. Therefore, the holder 7 and the lever 2a used in the first embodiment can be omitted.

Figure 5:
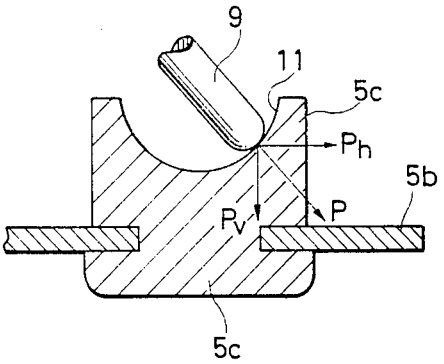
FIG. 5 is a partial enlarged diagram showing another embodiment of the reception portion of the snap switch of FIG. 4(*a*)

Alternatively, the reception portion 11 may be arranged such that, for example, as shown in FIG. 5, the end surface of the contact piece 5c is curved inwardly to create a semi-cylindrical surface to engage the pushing portion 9.

Figure 6:
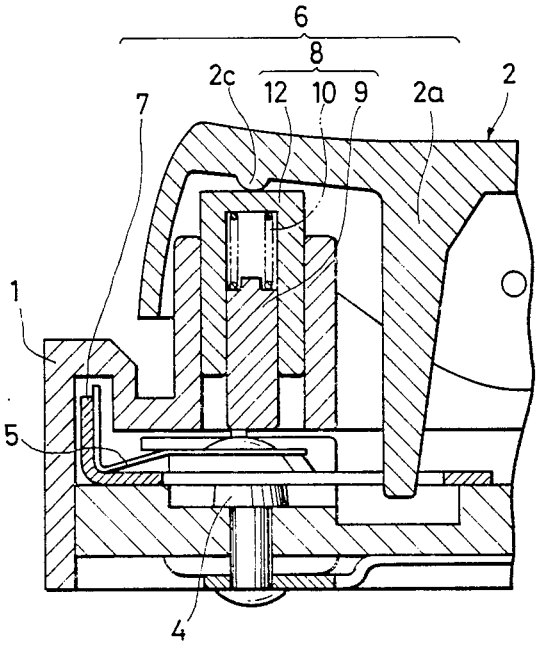
FIG. 6 is a partial cross-sectional view showing a third embodiment of the snap switch according to the present invention.

FIG. 6 shows a third embodiment of the snap switch according to the present invention. In this embodiment, a member 12, corresponding to the cylindrical portion 2b in the first embodiment, is vertically movably provided on the switch body 1, so that the pushing portion 9 and the spring 10 are disposed in the member 12.

As the knob 2 is rotated, a protrusion 2c formed on the knob 2 integrally therewith urges the member 12 down to carry out the same operation as in the first embodiment. At this time, however, the pushing direction by the pushing portion 9 coincides with the reversing direction of the dome-like portion 5b, so that the reversing and urging operations can be easily performed in comparison with the first embodiment.

As described above, according to the present invention, as the knob is rotated, the movable contact is urged against the fixed contact and caused to slide thereon, so that a good contact condition can be obtained even if dust, a carbide, or the like, adheres to the respective contact surfaces of the movable and fixed contacts.

What is claimed is:

1. A snap switch, comprising:

a switch body;

a fixed contact having a contact surface with a central axis substantially perpendicular thereto, mounted on the switch body;

a contact holder, movable relative to the fixed contact in a direction substantially parallel to the contact surface thereof, mounted on the switch body;

a movable contact, coupled to and movable with the contact holder, disposed opposite to and spaced from the fixed contact;

a contact operating knob means having a pushing portion and a lever portion, said knob means being rotatably mounted on the switch body, said pushing portion being disposed to move the movable contact in a direction substantially parallel to the axis of the fixed contact to abut the contact surface of the fixed contact upon rotation of said contact operating knob means through a predetermined rotational angle, and said lever portion being disposed to engage the contact holder for moving the contact holder in a direction substantially perpendicular to the axis of the fixed contact for sliding the movable contact along the contact surface of the fixed contact upon further rotation of said contact operating knob means through a predetermined rotation angle.

2. A snap switch as recited in claim 1, wherein the movable contact has a flexible reversing dome-like portion, said dome-like portion responding to a predetermined urging force to reverse positions from an original state for engaging the contact surface of the fixed contact, said dome-like portion returning to said original state upon removal of the urging force.

3. A snap switch comprising:

a switch body having two ends;

a pair of fixed contacts, mounted on opposite ends of the switch body, said fixed contacts each having a contact surface with a central axis substantially perpendicular thereto;

a pair of contact holders, mounted on opposited ends of the switch body, said contact holders each movable relative to the fixed contact in a direction substantially parallel to the contact surface thereof;

a pair of movable contacts mounted on opposite ends of the switch body, each coupled to and movable with a corresponding contact holder, disposed opposite to and spaced from the corresponding fixed contact;

a contact operating knob means, having two end portions, said knob means being rotatably mounted intermediate the two ends of the switch body, said end portions being susceptible to alternate up-down movements through a predetermined rotation angle and each having a pushing portion and a lever portion, each of said pushing portions being disposed to move the corresponding movable contact in a direction substantially parallel to the axis of the corresponding fixed contact upon rotation of the end portion corresponding thereto through said predetermined rotational angle, each said lever portion being dipsosed to move with said respective pushing portion to engage the corresponding contact holder for moving said contact holder in a direction substantially perpendicular to the central axis of the corresponding fixed contact for sliding the corresponding movable contact along the contact surface of the corresponding fixed contact upon further rotation of said end portion through said predetermined rotational angle.

4. A snap switch as recited in claim 3, wherein the movable contacts each have a flexible reversing dome-like portion, said dome-like portion responding to a predetermined urging force to reverse positions from an original state for engaging the contact surface of the corresponding fixed contact, said dome-like portion returning to its original state upon removal of the urging force.

5. A snap switch comprising:

a switch body;

a fixed contact having a contact surface with a central axis substantially perpendicular thereto, mounted on the switch body;

a contact holder movable relative to the fixed contact in a direction substantially parallel to the contact surface thereof, mounted on the switch body;

a movable contact coupled to and movable with the contact holder, disposed opposite to and spaced from the fixed contact;

a contact operating knob means having a lever portion, said knob means being rotatably mounted on the switch body, said lever portion being disposed to engage the contact holder for moving the contact holder in a direction substantially perpendicular to the central axis of the fixed contact, upon rotation of said knob means through a predetermined rotational angle;

pushing means mounted on the switch body disposed above the fixed and movable contacts and substantially aligned with the central axis of the fixed contact, said pushing means having a vertically moving member disposed to move in a direction parallel to and substantially coaxial with the central axis of the fixed contact;

protrusion means mounted on the contact operating knob means aligned with and disposed to engage the vertically moving member to abut and move the movable contact in a direction substantially parallel to the central axis of the fixed contact, upon rotation of the contact operating knob means through a predetermined rotational angle.

6. A snap switch as recited in claim 5, wherein the movable contact has a flexible reversing dome-like portion, said dome-like portion responding to a predetermined urging force to reverse positions from an original state for engaging the contact surface of the fixed contact, said dome-like portion returning to said original state upon removal of the urging force.

* * * * *